US005394992A

United States Patent [19]

Winkler

[11] Patent Number: 5,394,992

[45] Date of Patent: Mar. 7, 1995

[54] DOCUMENT SORTER

[75] Inventor: Theodore Winkler, Levittown, Pa.

[73] Assignee: Brandt, Inc., Bensalem, Pa.

[21] Appl. No.: 73,731

[22] Filed: Jun. 8, 1993

[51] Int. Cl.[6] ..... B07C 5/34

[52] U.S. Cl. ..... 209/552; 209/534; 271/303; 271/304; 271/3

[58] Field of Search ..... 271/3, 4, 304, 303, 271/298, 273; 209/534, 552

[56] References Cited

U.S. PATENT DOCUMENTS

| | | | |
|---|---|---|---|
| 4,326,636 | 4/1982 | Kawakami | 209/534 |
| 4,420,153 | 12/1983 | Winkler et al. | 271/304 |
| 4,694,963 | 9/1987 | Takesako | 209/534 |
| 4,784,274 | 11/1988 | Mori et al. | 271/273 X |
| 4,984,692 | 1/1991 | Obara | 209/583 |
| 5,088,722 | 2/1992 | Olexy | 271/304 |
| 5,184,709 | 2/1993 | Nishiumi et al. | 271/273 X |

*Primary Examiner*—David H. Bollinger
*Attorney, Agent, or Firm*—Shenier & O'Connor

[57] ABSTRACT

A sorter for separating a plurality of documents into two groups on the basis of characteristics which distinguish the documents of one group from the documents of the other group in which a cabinet has an input tray from which documents are fed one by one along a path past a sensor and between a pair of belts having divergent path portions between which a diverter responsive to the sensor is disposed and is adapted to divert documents alternatively to the nip between an upper pinch roller and one of the belts in its divergent path portion to cause the document to be deposited in an upper output tray by an upper stacker or to the nip between a lower pinch roller and the other belt in its divergent path portion to cause the document to be deposited in a lower output tray by a lower stacker in which the upper output tray and the upper stacker and the pinch rollers are mounted for movement as a unit between an operative position and an inoperative position at which the diverter is accessible with a magnetic coupling being provided between a shaft on the sorter frame and the upper stacker shaft.

19 Claims, 7 Drawing Sheets

DOCUMENT SORTER

FIELD OF THE INVENTION

The invention is in the field of document handling and, more particularly, it relates to a sorter for separating documents in accordance with one or the other characteristics thereof.

BACKGROUND OF THE INVENTION

Various devices are known in the prior art for separating documents in accordance with one or the other characteristics thereof. There are, for example, devices for testing documents such as currency bills and the like and separating acceptable bills from those which fail the test. Documents which are unacceptable are delivered to a rejection area or container from which they may later be removed. Other devices are known for separating documents and delivering them to individual internal bins.

Sorters of the prior art are relatively large, complicated and cumbersome. They do not permit ready access to the separated documents for subsequent operations. While most sorters of the prior art are configured to permit access to the document path to clear jams, such access providing means are relatively inconvenient to use.

One object of my invention is to provide a document sorter which is simple in construction and in operation.

Another object of my invention is to provide a document sorter which is capable of high speed operation.

A further object of my invention is to provide a document sorter provided with easily operable means for affording access to the location at which jams are most likely to occur.

A still further object of my invention is to provide a document sorter which delivers the separated documents to external trays which are readily accessible to the operator.

Still another object of my invention is to provide a document sorter which readily lends itself to the performance of various tests on documents being handled.

A still further object of my invention is to provide a document sorter which is small and compact.

Other and further objects of my invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views.

DESCRIPTION OF THE PREFERRED EMBODIMENT

Figure 1:
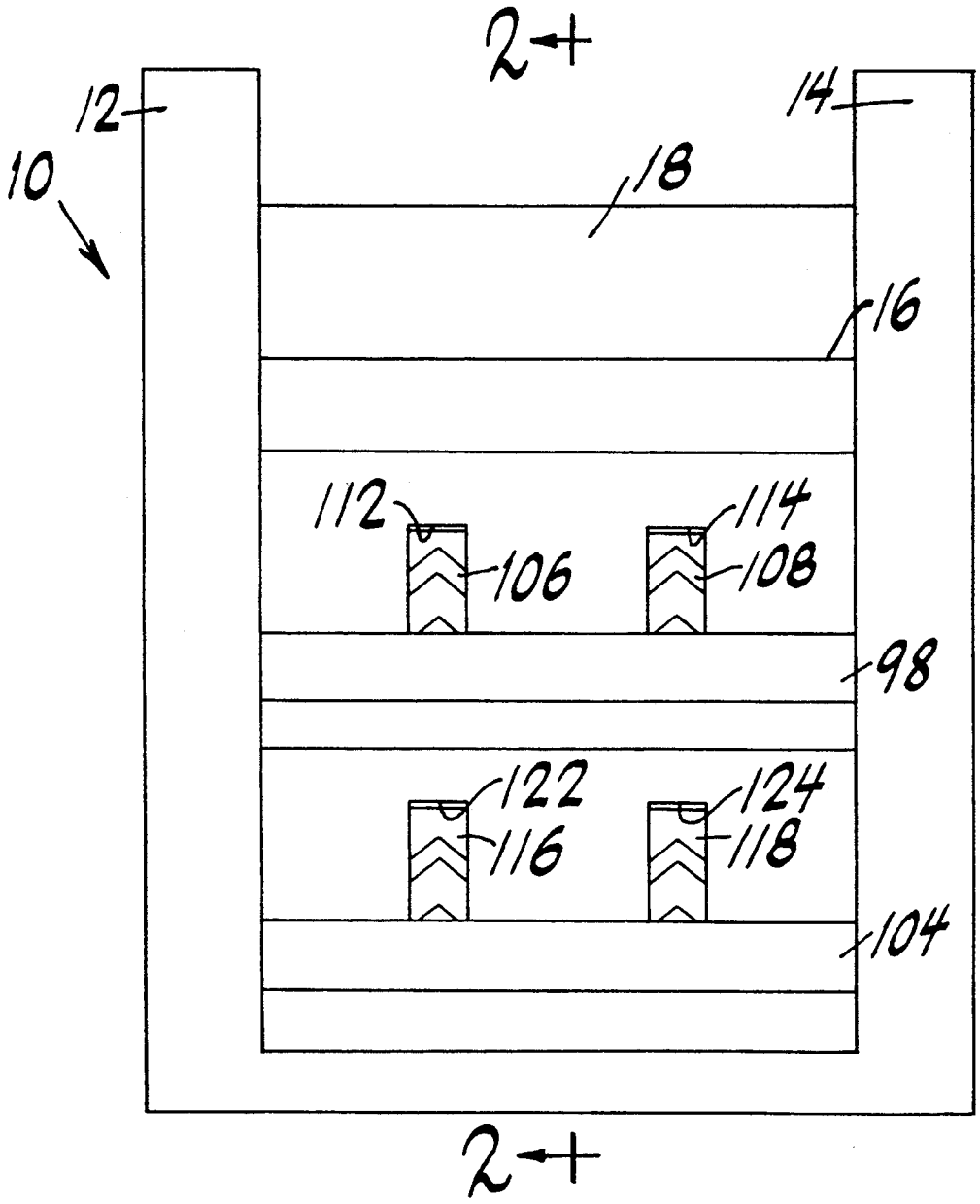
FIG. 1 is a front elevation of my document sorter.
Figure 2:
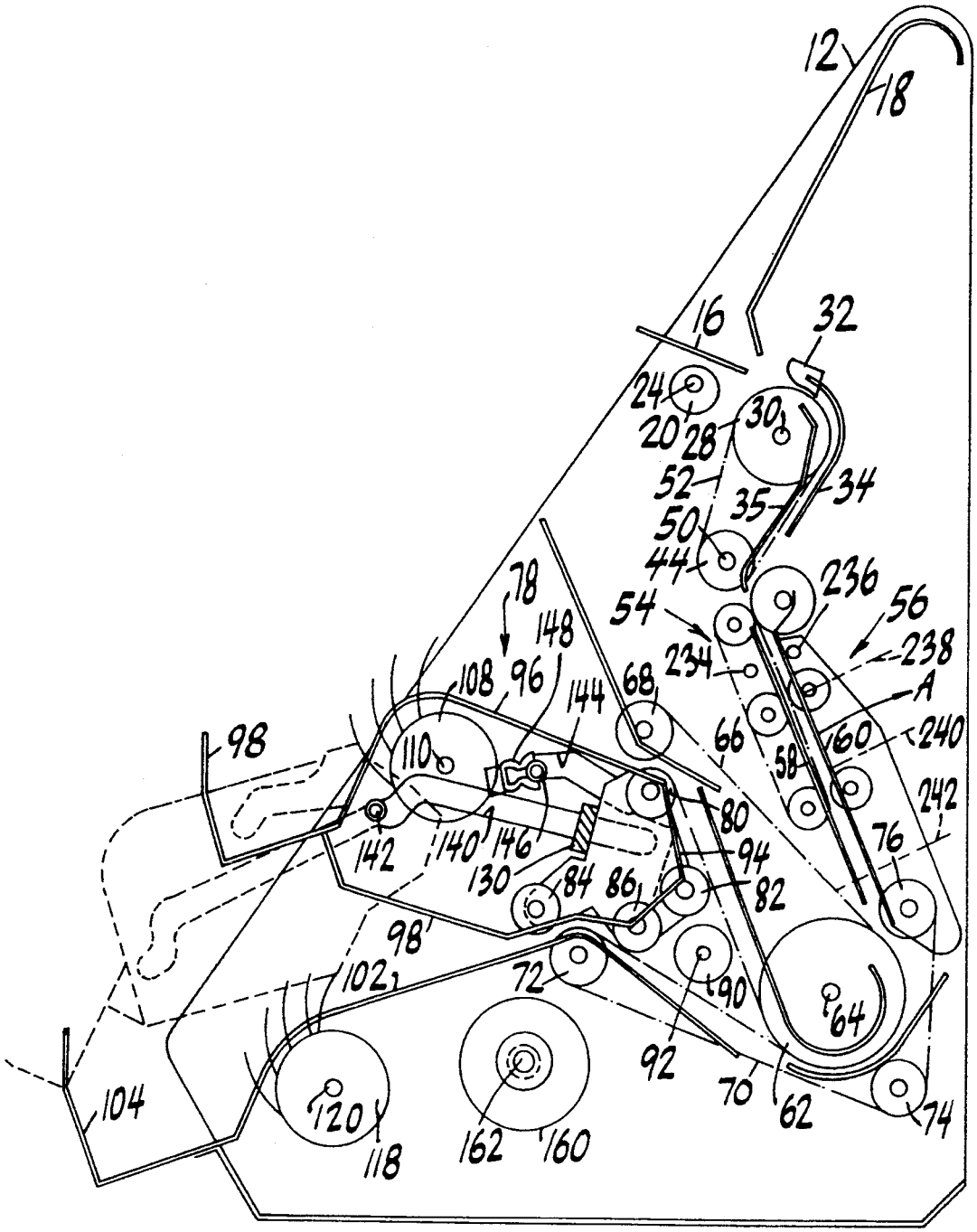
FIG. 2 is a sectional view of the sorter shown in FIG. 1 taken along the line 2—2 of FIG. 1.
Figure 3:
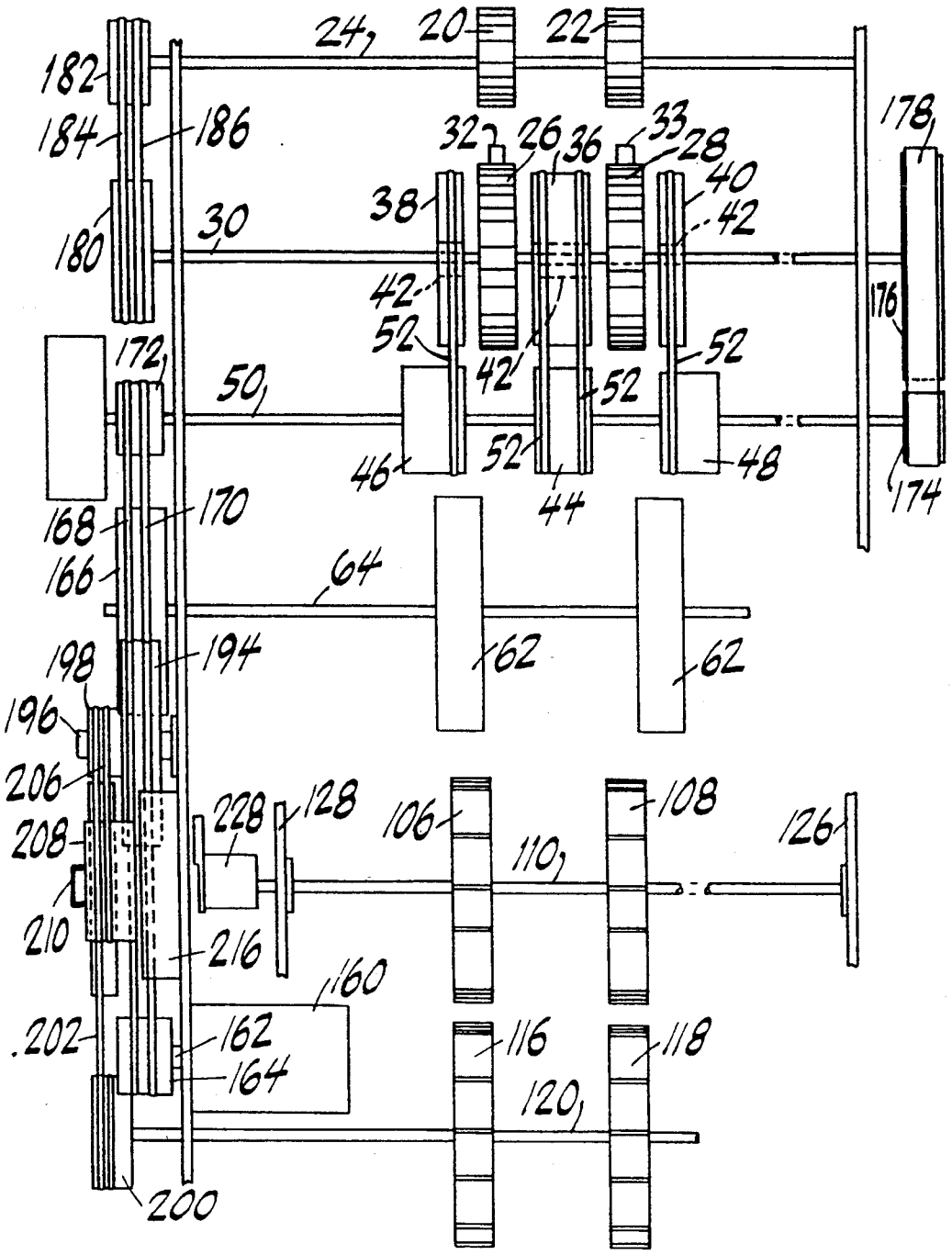
FIG. 3 is a diagrammatic view showing the drive system of my sorter.
Figure 4:
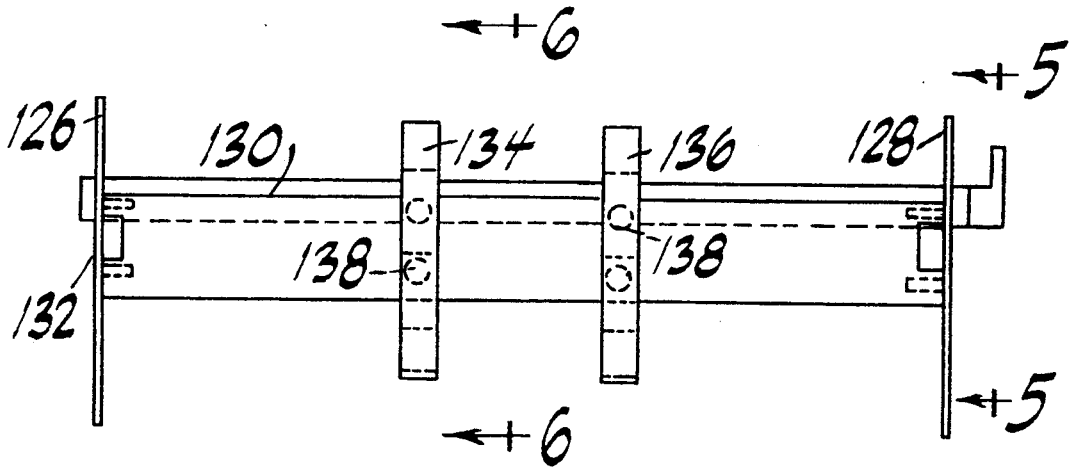
FIG. 4 is a front elevation of the movable stacker unit of my document sorter with parts removed.

Referring now to FIGS. 1 to 3, my sorter, indicated generally by the reference character 10, includes a left-hand subhousing 12 and a right-hand subhousing 14. The inner walls of these subhousings support an input tray 16 and a backing plate 18. In use of the sorter, a stack of documents to be separated are placed on the tray 16 with upper documents of the stack resting against the plate 18.

The sorter 10 includes a pair of eccentric picker rolls 20 and 22 supported on a shaft 24. As will be described hereinbelow, shaft 24 is driven to cause the eccentric picker rolls 20 and 22 to move upwardly through openings in the platform 16 slightly to elevate the stack and to advance the lowermost sheet toward a pair of feed wheels 26 and 28 carried by a shaft 30. Further, as will be described hereinbelow, shaft 30 is driven to advance the lowermost sheet of the stack into the nips between a pair of strippers 32 and 33 and the respective feed wheels 26 and 28. Strippers 32 and 33 ensure that only the lowermost sheet of the stack is advanced along the path between a curved outer guide 34 and cooperating inner guide 35.

Shaft 30 also supports a central accelerator idler roller 36 disposed between the feed rollers 26 and 28 and a pair of outboard accelerator idler rollers 38 and 40. Bearings 42 carried by the shaft 30 support the rollers 36, 38 and 40 for rotary movement relative to the shaft.

My apparatus includes a central driven accelerator roller 44 and a pair of outboard driven accelerator rollers 46 and 48 carried by a shaft 50 for rotation therewith. Respective accelerator belts 52 connect the rollers or pulleys 44, 46 and 48 with the rollers or pulleys 36, 38 and 40.

Belts 52 direct sheets into the space between a lower roller assembly indicated generally by the reference character 54 and an upper pinch roll assembly indicated generally by the reference character 56. The sheet path between these two structures is formed by an inner guide plate 58 and an outer guide plate 60 forming part of the unit 56. Preferably, the unit 56 is adapted to swing in the direction of the arrow A for access to the paper path.

A pair of rolls 62 carried by a shaft 64 for rotation therewith support upper path belts 66 which extend from the rollers 62 around return rollers 68 and back to the rollers 62.

The rollers 62 also receive lower paper path belts 70 which extend from the rollers 62 around reversing rolls 72 around idler rolls 74 and around return roll 76 back to the rollers 62.

From the structure just described, it will be appreciated that the lowermost sheet on the platform 16 is directed along the path between guides 34 and 35 and into the path portion formed by guide plates 58 and 60 and thence between the upper and lower path forming belts 66 and 70 around the rollers 62 to the location at which belts 66 and 70 diverge. At this location, the sheets are directed generally toward a movable assembly indicated generally by the reference character 78 which, in a manner to be described hereinbelow, is movable between the full line position shown in FIG. 2 and the broken line position. This assembly 78 supports a pair of upper pinch rolls 80 and 82 and a pair of lower pinch rolls 84 and 86. When the movable assembly 78 is in the full line position, upper pinch rolls 80 and 82 form nips with the belt 66 and the lower pinch rolls 84 and 86 form nips with the belt 70.

My sorter includes a gating roller 90 carried by a shaft 92 which is rotated in one direction or the other alternatively to direct a sheet upwardly into the nip between pinch roller 82 and belt 66 or downwardly into the nip between pinch roller 86 and the belt 70. The details of pinch roller 90 are shown and described in Winkler et al U.S. Pat. No. 4,420,153, the disclosure of which is incorporated herein by reference. It is to be understood that a fluidic or knife edge diverter could be substituted for the rotary diverter 90 if desired.

The movable assembly 78 includes an upper guide part 94 which directs a sheet emerging from the nip between pinch roller 82 and belt 66 into the nip between pinch roller 80 and belt 66 from whence the sheet moves onto an upper guide surface 96 of the upper output tray 98. As will be explained more fully hereinbelow, the member forming guide surface 96 and the upper output tray 98 is part of the movable assembly 78.

A sheet emerging from the nip between pinch roller 84 and belt 70 is directed onto an upper guide surface 102 of the lower output tray 104.

A sheet moving along the guide surface 96 encounters a pair of upper stacker wheels 106 and 108 mounted in spaced relationship on a shaft 110 carried by the movable assembly 78. The stacker wheel blades of the wheels 106 and 108 extend through openings 112 and 114 in the member forming guide surface 96 and the upper output tray 98.

A sheet traveling along the guide surface 102 encounters lower stacker wheels 116 and 118 mounted in spaced relationship on a shaft 120 supported in the subhousings 12 and 14. Respective openings 122 and 124 in the member forming guide 102 and lower output tray 104 accommodate the blades of the lower stacker wheels 116 and 118.

Referring now to FIGS. 2 and 4 to 6, the movable assembly 78 includes a pair of side plates 126 and 128 to which the guide member 94 and the member forming guide surface 96 and the upper output tray 98 are secured in any manner known to the art.

The assembly 78 includes a pinch bar 130 extending between the side plates 126 and 128 and secured thereto by any suitable means, such for example as screws 132. A pair of bearing plates 134 and 136 are secured to the pinch bar 130 by means of screws 138. As can be seen by reference to FIG. 4, the two bearing plates 134 and 136 are secured to the pinch bar 130 in spaced relationship to each other within the space between side plates 126 and 128.

Figure 5:
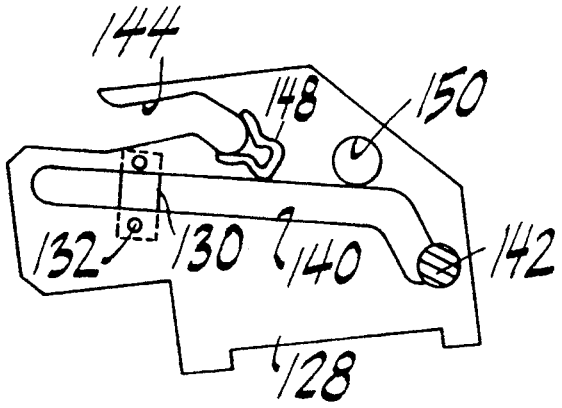
FIG. 5 is a sectional view of the unit shown in FIG. 4 taken along the line 5—5 of FIG. 4.
Figure 6:
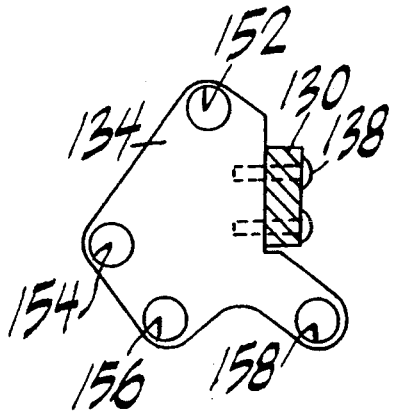
FIG. 6 is a sectional view of the unit shown in FIG. 4 taken along the line 6—6 of FIG. 4.

As can be seen by reference to FIG. 5, I form each of the side plates 126 and 128 with a closed end slot 140 which receives a roller 142. The rollers 142 associated with the slots 140 of the respective side plates 126 and 128 are carried by the inner walls of subhousings 12 and 14 to support the assembly 78 for movement between an operative position and an inoperative position at which the gate roller 90 is accessible in a manner to be described more fully hereinbelow.

I form each of the plates 126 and 128 with a rearwardly opening slot 144 which receives a roller 146 on the inner wall of the adjacent subhousing 12 or 14 as the assembly 78 is moved to its operative position. I provide a snap lock 148 at the closed end of each of the slots 144 to receive the associated roller 146 to lock the subassembly 78 in place. Each of the plates 126 and 128 also is provided with an opening 150 which receives a bearing for supporting the shaft 110 on which the upper stacker wheels are mounted.

Each of the bearing plates 134 and 136 is formed with a plurality of openings 152, 154, 156 and 158 for receiving bearings (not shown) which support the shafts of rollers 80, 82, 84 and 86. Preferably, I form the rollers 80, 82, 84 and 86 of ABS or aluminum.

From the structure thus far described, it will be seen that the movable subassembly 78 is made up of the member forming guide surface 96 and upper tray 98, the guide member 94, the side plates 126 and 128 between which members 96 and 94 extend, the pinch bar 130 carrying the plates 134 and 136, the rollers 80, 82, 84 and 86 supported on the plates 134 and 136, the snap locks 148, the upper stacker shaft 110 and the stacker wheels 106 and 108 carried thereby.

Figure 2A:
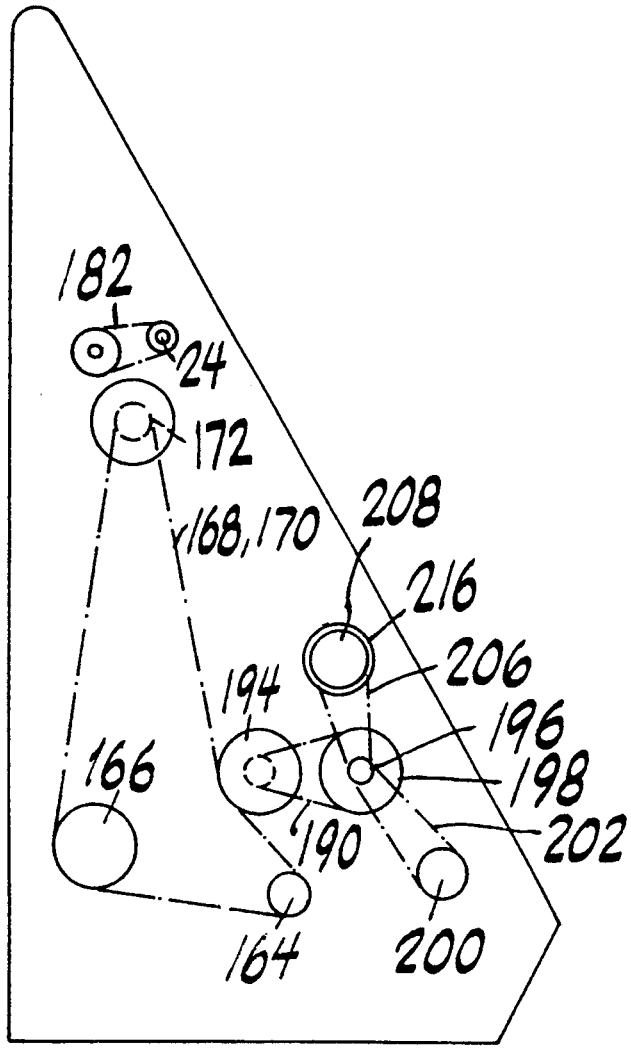
FIG. 2A is a sectional view of my document sorter illustrating the drive mechanism thereof.

Referring now to FIGS. 2, 2A and 3, the drive system of my sorter includes a motor 160 having a shaft 162 carrying a pulley 164.

A pair of belts 168 and 170 driven by pulley 164 drive a relatively large diameter pulley 166 secured to shaft 64 and a pulley 172 secured to shaft 50. Shaft 50 drives a relatively small roller 174 connected by a timing belt 178 to a relatively large diameter roller 176 on shaft 30.

Pulley 180 on shaft 30 drives a picker shaft pulley 182 by means of belts 184 and 186.

Pulley 194 driven by belts 168 and 170 for reverse rotation relative to pulley 194 is connected by belt 190 to a large diameter portion of an intermediate pulley 198 on shaft 196. A relatively small diameter portion of pulley 198 is connected to a lower stacker drive pulley 200 by a belt 202.

Figure 7:
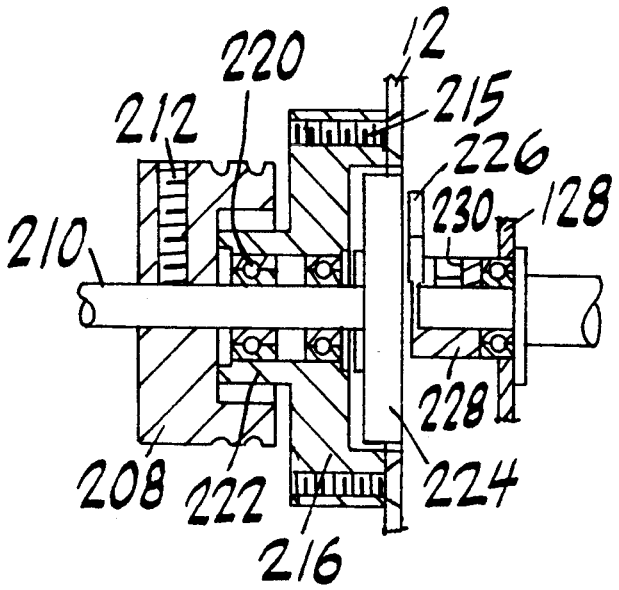
FIG. 7 is a sectional view of the drive system of the movable stacker unit of my document sorter.
Figure 8:
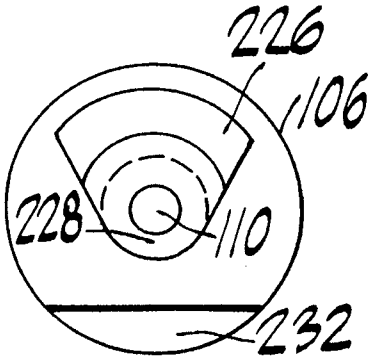
FIG. 8 is an end elevation of the movable stacker unit of my sorter with parts removed.

Referring now to FIGS. 3, 7 and 8, a belt 206 provides a driving connection between the pulley 198 and pulley 208 secured to the upper stacker wheel drive shaft 210 by means of a set screw 212 or the like.

I provide a magnetic drive coupling between the shaft 210 and shaft 110 carrying the upper stacker wheels 106 and 108 so as to permit the unit 78 to be moved from its operative position to the position at which gate 90 is accessible without the disassembly of any parts. Pulley 208 on shaft 210 is received by hub 222 formed on a magnet housing 216 secured to the inner wall of subhousing 12 by any suitable means, such as by screws 215. Two bearings 220 disposed within a bore in the hub 222 support shaft 210.

Housing 216 receives a magnet 224 mounted on the end of shaft 210 for rotation therewith.

It will be seen that the pinch area has a common path portion between guides 58 and 60 along which the rollers carry documents or bills captured therebetween. This common path portion forms an extended sensing area in which various sensors may be placed. These sensors can be optical, acoustic or magnetic. They can be arranged to determine document density, limpness, length, width, thickness and magnetic properties and to read bar codes.

By way of example, I dispose a source of light 234 and associated sensor 236 on opposite sides of the path of a sheet captured between the rollers and moving through the space between guides 56 and 58. I may provide a number of other sensing units at locations indicated by broken lines 238, 240 and 242 along the path of a bill moving through the space between guides 56 and 58. The other sensors 236, 238, 240 and 242 may be of any suitable type known to the art arranged to perform any suitable test.

One test to be performed is distinguishing between the two faces of a bill so as to send bills having one face up to one of the two output trays 98 and 104 and to send bills having the other face up to the other of the two output trays. It will readily be appreciated that a facing operation of this type is a preliminary to other tests which may be performed on the bill and which require all of the bills to have the same face up during the test. It will be seen that my apparatus greatly facilitates this operation by delivering bills having one face up to one of the two trays 98 and 104 and bills having the other face up to the other tray. The bills may then readily be manually arranged in a stack of bills all having the same face up and being placed on the input tray 16 for the subsequent operation. Subsequent operations may be fitness tests, bar code reading, separation of a "rogue" note of a different denomination from a stack of notes all thought to be of the same denomination. Since the details of the particular sensors and the control of the various operations does not per se form any part of my invention, they will not be described in detail.

In operation of my apparatus 10, assuming that a facing operation first is to be performed on a stack of bills, the stack is placed on input tray 16 and the operation is begun by feeding the bills one at a time along a path between the guides 56 and 58 at which the sensors can examine the bills. For example, in the facing operation the sensor may put out a first signal indicating that the dark side of the bill is up and a second signal indicating that the lighter side of the bill is up. After examination, all of the bills are carried around the accelerator roller 40 and directed toward the gate roller 90.

Figure 9:
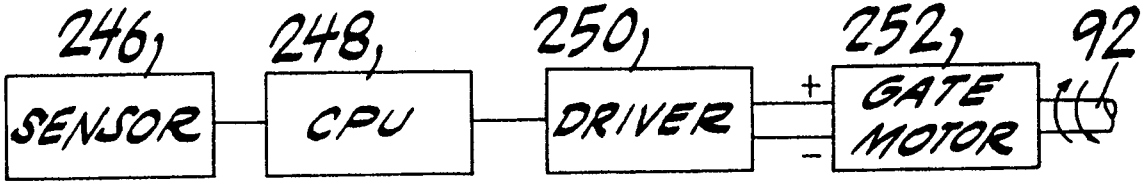
FIG. 9 is a block diagram illustrating the gate drive system of my sorter.

Referring now to FIG. 9, one of the sensors indicated by the block 246, puts out a signal which is fed to the central processing unit 248 which actuates a driver 250 to put out a signal on a "plus" input line to the gating motor 252 when one side of the bill is up and to put out a "minus" signal on another input to the gate motor 252 when the other side of the bill is up. In response to these signals, motor 252 drives shaft 92 in one direction or the other to cause the gate roller 90 to direct the bill toward the upper stackers 106 and 108 or toward the lower stackers 116 and 118.

The control of the gating roller 90, in response to a sensor signal, is more fully described in Horvath et al U.S. Pat. No. 4,381,447, the disclosure of which is incorporated herein by reference.

My sorter is intended to handle documents at a high rate of speed approaching 2,000 documents per minute. In order to permit the sensors to distinguish successive documents and for the purpose of counting the documents, the acceleration rollers are driven at such a higher speed than the feed rollers 26 and 28 as to form a space between successive documents passing along the belt feed path forming the extended sensing area. The spacing S between successive documents is given by the relationship:

$$S = L_D (V_A / V_f - 1)$$

where $L_D$ is the length of the document in the direction of feed, $V_A$ is the acceleration velocity in inches per second, and $V_F$ is the feed velocity in inches per second.

Assuming a feed roll velocity of 65 ips for the feed rollers 26 and 28, and an acceleration roll velocity of 143 ips for a document having a length in the feeding direction of 3.7" the spacing S would be 4.44". For a document having a length in the feeding direction of 2" the spacing would be 2.4". The time required for a 3.7" document and interdocument spacing of 4.44" to pass a given point would be:

$$(3.7+4.44)/143 = 0.05664 \text{ seconds.}$$

Thus, in one minute about 1,060 documents would pass the given point. Similarly, approximately 1,950 two-inch documents would pass the given point.

From the foregoing, it will readily be appreciated that the speed of reversal of the gating roller must be extremely fast and its rotational speed must be high if the desirable high rates of bill handling are to be achieved. It will be seen that a bill or document passing through my apparatus is under the control of the pinch rollers over most of its travel except when the leading edge is freed from between the belts 66 and 70 as they diverge in approaching the roller 90. Owing to the facts just discussed, the region of the feed roller 90 is the most likely area in which a jam may occur.

My moveable unit 78, including the upper stacker wheels 106 and 108 and the pinch wheels 80, 82, 84 and 86, permits ready access to the region of the roller 90 without disassembly of any parts. In the operative position of the unit it is locked into place by the snap locks 148 in engagement with the rollers 146. When it is desired to move the unit 78 to a position at which the gating roller 90 is accessible, the unit first is pulled slightly outwardly to move the rollers 146 out of engagement with the locks 148. The unit 78 then is pivoted slightly in a counterclockwise direction, as viewed in FIG. 2, and then pulled outwardly until the rollers 146 move out through the open rear ends of slots 144. The unit 78 may then move fully into the broken line position shown in FIG. 2 in which the gating roller 90 is readily accessible.

As can be seen by reference to FIG. 8, I provide the stacker wheel 106, for example, with a counterweight 232 which causes the magnetic follower to occupy an up position when the machine is turned off. That is to say, when power is turned off so that shaft 110 is no longer positively driven, counterweight 232 will position the follower 226 in the position shown in FIG. 8. In this position of the follower, it will clear roller 142 as the unit 78 is moved out of its operative position. If no such counterweight were provided, the possibility exists that the follower 226 would engage the roller 142 as the unit 78 was being moved to its broken line position, thus leading to difficulty in moving the unit to that position.

When the unit 78 is to be restored to its operative position, it is moved upwardly with slots 140 riding along rollers 142. The unit is then manipulated until rollers 146 enter the open rear ends of slots 144. As the unit is moved fully into its operative position, locks 148 engage rollers 146 releasably to lock the unit in position. Further, as the unit moves into its operative position, rollers 80 and 82 engage belt 66 so as to form nips therewith. Rollers 84 and 86 engage belt 70 so as to form nips therewith.

The face of magnet 224 is substantially flush with the inner surface of the inner side wall of housing 12 to permit the magnet follower 226 to be moved into and out of operative position with relative ease. It is to be noted further that I mount the shaft 110 on sideplates 126 and 128 so as to permit limited axial movement thereof. Thus, once the follower 226 has been moved into its operative position, it can be drawn into contact with the base of the magnet 224.

It will be seen that I have accomplished the objects of my invention. I have provided a document sorter which is simple in construction and in operation. My sorter is small and compact for the results achieved thereby. It is capable of high speed operation. I provide my sorter with easily operable means for affording access to the location at which jams are most likely to occur. My sorter delivers the separated documents to external trays which are readily accessible to the operator. My sorter has an extended sensing area which permits various tests to be made on a document being handled.

It will be understood that certain features and subcominations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A sorter for separating a plurality of documents into two groups on the basis of characteristics which distinguish the documents of one group from the documents of the other group including in combination a cabinet having an input tray for receiving a plurality of documents to be sorted, first and second externally accessible output trays, respective stackers having shafts adapted to be driven to cause the stackers to deliver documents to the respective output trays, a motor in said cabinet, a drive train including an interruptible coupling between said motor and one of said shafts, means adapted to be activated alternatively to direct a document fed to said directing means to one or the other of said output trays, means for feeding documents one by one from said input tray along a path toward said directing means, sensing means disposed along said path for testing said documents for said characteristics, means responsive to said sensing means for actuating said directing means, and means mounting one of said stackers and its associated drive shaft on said cabinet for movement from an operative position to a position at which said coupling is interrupted and said directing means is accessible.

2. A sorter as in claim 1 in which said stackers are disposed one above the other to provide an upper stacker and a lower stacker and in which said one stacker is said upper stacker.

3. A sorter as in claim 1 including a motor in said cabinet, said motor having an output shaft, and a driving train comprising a magnetic coupling between said output shaft and said one stacker shaft.

4. A sorter as in claim 1 in which said feeding means comprises first and second belts, and means constraining said belts to follow respective paths comprising a common path portion extending from said input tray toward said directing means.

5. A sorter as in claim 4 in which said belt paths comprise respective divergent path portions extending from said directing means toward the stackers, said directing means being located between said divergent path portions, first and second pinch rollers, said one stacker mounting means mounting said pinch rollers for movement between positions at which they form nips with said first and second belts in their divergent path portions in the operative position of said one stacker and positions remote from said belts in the other position of said one stacker to expose said directing means.

6. A sorter as in claim 5 in which said coupling is a magnetic coupling.

7. A sorter for separating a plurality of documents into two groups on the basis of characteristics which distinguish the documents of one group from the documents of the other group including in combination, a cabinet having an input tray for receiving a plurality of documents to be sorted, a first output tray on said cabinet, a first stacker having a shaft supported on said cabinet and adapted to be driven to deposit documents on said first output tray, a movable unit comprising a second output tray and a second stacker having a shaft supported on said unit and adapted to be driven to deposit documents on said second output tray, diverting means adapted to be actuated to direct documents fed thereto alternatively to one or the other of said output trays, means for feeding documents one-by-one from said input tray to said diverting means, sensing means disposed along said path for testing said documents for said characteristics, means responsive to said sensing means for actuating said diverting means, means mounting said unit on said cabinet for movement between an operative position and an inoperative position at which said diverting means is accessible, a motor in said cabinet, said motor having an output shaft, means connecting said output shaft to said first stacker shaft, and means including an automatically releasable coupling between said output shaft and said second stacker shaft, said automatically releasable coupling comprising a first member connected to said output shaft and a second member connected to said second stacker shaft, said members automatically establishing said coupling in the operative position of said unit and disestablishing the coupling upon movement of the unit to its inoperative position.

8. A stacker as in claim 7 in which said stacker is an upper stacker.

9. A stacker as in claim 7 in which said coupling is a magnetic coupling.

10. A stacker as in claim 7 including means for releasably locking said unit in its operative position.

11. A stacker as in claim 7 including means for limiting the movement of said stacker in a direction toward its inoperative position.

12. A stacker as in claim 7 in which said cabinet has a side wall and said unit comprises a side plate, said means mounting said unit comprising a closed end slot on one of said side wall and said end plate and a roller on the other of said side wall and each plate disposed in said slot.

13. A stacker as in claim 12 in which slot is a first slot and said roller is a first roller, said means mounting said unit comprising a rearwardly opening second slot on said side plate and a second roller on said side wall for entering said second slot as said unit moves toward its operative position.

14. A stacker as in claim 13 including a spring clip on said side plate for engaging said second roller as said unit moves into its operative position releasably to lock said unit in its operative position.

15. A stacker as in claim 12 in which said slot is in said side plate and said roller is on said side wall, said second member is a segmental member, said stacker including means for biasing said member to a position clear of said roller as said unit moves from its operative position to its inoperative position.

16. A sorter as in claim 7 in which said diverting means comprises a rotating member.

17. A sorter as in claim 7 in which said feeding means comprises first and second belts, and means constraining said belts to follow respective paths comprising a common path portion extending toward said diverting means.

18. A sorter as in claim 17 in which said belt paths comprise respective divergent path-portions extending from said directing means toward said stackers, said diverting means being disposed between said divergent path portions, said unit comprising respective first and second pinch rollers adapted to form nips with said belts in their divergent path portions in the operative position of said unit and to be removed from said belts in the inoperative positions so as to expose said diverting means.

19. A sorter as in claim 17 in which said second output tray is an upper output tray and said second stacker is an upper stacker.

* * * * *

UNITED STATES PATENT AND TRADEMARK OFFICE

CERTIFICATE OF CORRECTION

PATENT NO. : 5,394,992
DATED : March 7, 1995
INVENTOR(S) : Theodore Winkler

It is certified that error appears in the above-indentified patent and that said Letters Patent is hereby corrected as shown below:

Column 7, Claim 3, lines 1 and 2 -
delete "including a motor in said cabinet".

Claim 3, lines 3 and 4 -
change "a driving train" to
-- said interruptible coupling --.

Column 8, Claim 8, line 1 -
after "said" insert -- second --.

Signed and Sealed this

Twenty-third Day of May, 1995

*Attest:*

*Attesting Officer*

BRUCE LEHMAN

*Commissioner of Patents and Trademarks*